US005688741A

United States Patent [19]

Carrazza et al.

[11] Patent Number: 5,688,741

[45] Date of Patent: Nov. 18, 1997

[54] PROCESS AND CATALYST FOR UPGRADING HEAVY HYDROCARBON

[75] Inventors: Jose Carrazza; Pedro Pereira; Nelson Martinez, all of San Antonio de Los Altos, Venezuela

[73] Assignee: Intevep, S.A., Caracas, Venezuela

[21] Appl. No.: 406,073

[22] Filed: Mar. 17, 1995

[51] Int. Cl.[6] ..... C10G 13/02; B01I 23/78

[52] U.S. Cl. ..... 502/344; 502/326

[58] Field of Search ..... 502/326, 344

[56] References Cited

U.S. PATENT DOCUMENTS

| | | | |
|---|---|---|---|
| 3,340,055 | 9/1967 | Dowden et al. | 502/326 |
| 3,676,331 | 7/1972 | Pitchford | 208/212 |
| 3,798,178 | 3/1974 | Soderquist et al. | 502/326 |
| 4,048,246 | 9/1977 | Antos | 502/326 |
| 4,743,357 | 5/1988 | Patel et al. | 208/122 |
| 5,171,914 | 12/1992 | Hamilton, Jr. | 502/326 |
| 5,427,993 | 6/1995 | Perry et al. | 502/326 |

FOREIGN PATENT DOCUMENTS 612327 10/1926 France .

*Primary Examiner*—Helane Myers
*Attorney, Agent, or Firm*—Bachman & LaPointe, P.C.

[57] ABSTRACT

A catalyst for use in a process for steam conversion of a heavy hydrocarbon feedstock includes the steps of: providing a heavy hydrocarbon feedstock; providing a catalytically active phase comprising a first metal and a second metal wherein said first metal is a non-noble Group VIII metal and said second metal is an alkali metal; and contacting said feedstock with steam at a pressure of less than or equal to about 300 psig in the presence of said catalytically active phase so as to provide a hydrocarbon product having a reduced boiling point. The catalyst may be supported on a support material or mixed directly with the feedstock and comprises a first metal selected from the group consisting of non-noble Group VIII metals and mixtures thereof and a second metal comprising an alkali metal wherein said catalyst is active to convert said heavy hydrocarbon at a pressure of less than or equal to about 300 psig.

17 Claims, No Drawings

PROCESS AND CATALYST FOR UPGRADING HEAVY HYDROCARBON

BACKGROUND OF THE INVENTION

The invention relates to a catalyst and a process for upgrading a heavy hydrocarbon feedstock which provides a high rate of conversion of the heavy hydrocarbon feedstock to lighter more valuable hydrocarbon products.

Various processes are known in the art for converting heavy hydrocarbons into lighter more valuable liquid and gaseous products.

One known process involves thermal cracking such as visbreaking or delayed coking. However, thermal cracking processes typically provide a low rate of conversion (less than 40% wt), and/or high rate of production of undesirable coke products.

Another process involves the catalytic treatment of the hydrocarbon in the presence of hydrogen gas at high pressure. Catalytic treatment with hydrogen gas provides high rates of conversion but requires extensive capital investment associated with hydrogen generation and compression facilities which require operation at high pressures.

An alternative to the foregoing processes involves contacting the feedstock with steam. Processes utilizing steam are disclosed in U.S. Pat. No. 3,676,331 to Pitchford and U.S. Pat. No. 4,743,357 to Patel et al. The processes disclosed in these patents provide limited improvements to rates of conversion of heavy hydrocarbons. However, there remains, thus, a need for a process and catalyst wherein high rates of conversion of heavy hydrocarbons are obtained without high pressure, complicated and costly equipment, or costly ingredients or additives.

It is therefore the primary object of the present invention to provide a process and catalyst for steam conversion of heavy hydrocarbons wherein a high rate of conversion to desired lower boiling point products is achieved.

It is another object of the invention to provide a process and catalyst for steam conversion of heavy hydrocarbons wherein relatively low pressures are used and no hydrogen generation or compression facilities are required.

It is still another object of the present invention to provide a process and catalyst for steam conversion of heavy hydrocarbons which utilizes materials which are relatively inexpensive and readily available.

It is a further object of the present invention to provide a catalyst and steam conversion process for using the catalyst to convert heavy hydrocarbons wherein high rates of production of undesirable coke products are avoided.

Other objects and advantages of the present invention will appear herein below.

SUMMARY OF THE INVENTION

The foregoing objects and advantages, and others, are readily attained in accordance with the present invention.

According to the invention, a process for steam conversion of a heavy hydrocarbon feedstock is provided which comprises the steps of: providing a heavy hydrocarbon feedstock; providing a catalytically active phase comprising a first metal and a second metal wherein said first metal is a non-noble Group VIII metal and said second metal is an alkali metal; and contacting said feedstock with steam at a pressure of less than or equal to about 300 psig in the presence of said catalytically active phase so as to provide a hydrocarbon product having a reduced boiling point.

The catalyst according to the present invention comprises a first metal selected from the group consisting of non-noble Group VIII metals and mixtures thereof and a second metal comprising an alkali metal wherein said catalyst is active to convert heavy hydrocarbon at a pressure of less than or equal to about 300 psi. According to the invention, said first metal is preferably selected from the group consisting of iron, cobalt, nickel and mixtures thereof, and said second metal is preferably selected from the group consisting of potassium, sodium and mixtures thereof.

DETAILED DESCRIPTION

The invention relates to a catalyst and a process for treating heavy hydrocarbon feedstock so as to upgrade or convert the feedstock into more desirable lower boiling point products.

According to the invention, heavy hydrocarbon feedstock treated with steam in the presence of the catalyst of the present invention is converted to lighter more valuable products. During treatment, hydrogen is transferred from the steam to the hydrocarbon so as to provide a product having an increased mole ratio of hydrogen to carbon and a reduced boiling point.

The composition of a heavy hydrocarbon feedstock such as crude oil or bitumen is characterized by determining the weight fractions of the feedstock which fall into four boiling point ranges. The ranges of interest are as follows: room temperature to 200° C. (gasoline); 200° C. to 350° C. (diesel); 350° C. to 500° C. (gas-oil); and more than 500° C. (residue). According to the invention, a process and catalyst are provided for converting the residue fraction having a boiling point greater than 500° C. into lower boiling point products having increased commercial value.

According to the invention, a catalyst and process are provided for steam conversion of a heavy hydrocarbon feedstock which provides an excellent rate of conversion of the high boiling point range fraction without undesirable increases in production of coke and other low value products and without requiring costly equipment or process additives.

The catalyst according to the invention comprises an active phase including a first metal and a second metal which in combination serve to provide excellent activity toward the desired conversion reactions in steam treatment processes. The metals according to the invention may be supported on a support material or may be provided as an additive for direct mixing with the feedstock as will be described below.

According to the invention, the first metal is a non-noble metal selected from Group VIII of the Periodic Table of Elements, preferably iron, cobalt, nickel or mixtures thereof.

The second metal according to the invention is an alkali metal, preferably potassium, sodium or mixtures thereof.

According to the invention, it has been found that the combination of first and second metals as set forth above for use in steam treatment of heavy hydrocarbons under low pressures serves to provide an excellent rate of conversion of the heavy hydrocarbon feedstock into more valuable lower boiling point products.

The first and second metals may preferably be supported on a mesoporous support material to provide a catalyst which according to the invention is contacted with the feedstock during steam treatment. The support material may preferably be selected from the group consisting of silica, aluminosilicate, alumina, carbon based material, and mixtures thereof. The support material preferably has a pore volume of at least about 0.3 ml/g, and may be provided as an extrusion, as a particulate or granular media or powder, or in any other desired form. Examples of suitable support materials include silicas, aluminas, both natural and synthetic aluminosilicates, cokes from either petroleum or coals, and mesoporous carbon based materials obtained from either vegetable or animal sources.

According to the invention, the metals may be provided on the support material by impregnation or dispersion onto the support material in accordance with known techniques, or by any other manner known in the art. The support material with supported metals is also preferably calcined in accordance with known techniques prior to use in the process of the present invention.

The catalyst according to the invention may also be provided in the form of an additive to be mixed directly with the feedstock to be treated. In this regard, according to the invention, the active metal phases may be provided in the form of one or more oil soluble salts of the desired metal which may then be readily dissolved into the feedstock. Suitable oil soluble salts include acetyl-acetonate salt, salts of fatty or naphthenic acids, organometallic compounds and the like.

One or both metals may also be provided according to the invention in the form of a water soluble salt to be dissolved in the water phase of a water in oil emulsion which is then mixed with the feedstock. Suitable water soluble salts include nitrates, chlorides, sulfates, acetates and the like.

In further accordance with the invention, one or both metals may also be provided in the form of a surfactant or emulsifier for stabilizing a water in oil emulsion to be added to or mixed with the feedstock. Suitable surfactant includes anionic surfactants such as sodium or potassium salts of fatty acids or naphthenic acids, soaps, alkyl sulphonates, alkyl ether sulfates and the like.

The catalyst according to the invention has been found to provide excellent rates of conversion of the high boiling point fractions of a heavy hydrocarbon feedstock when used during steam conversion processes. Such processes are desirable in accordance with the invention because steam is readily available in the hydrocarbon treatment or production facility, particularly at the relatively low pressures which have been found according to the invention to be particularly desirable as will be set forth below.

The catalyst according to the invention is useful in upgrading heavy hydrocarbon feedstock so as to convert high boiling point fractions of the feedstock into desired lower boiling point products.

In further accordance with the invention, a process is provided whereby a heavy hydrocarbon feedstock is contacted with steam in the presence of the catalyst according to the invention so as to provide a conversion of the high boiling point fractions of the feedstock as desired. According to the invention, the process is carried out at a relatively low pressure and does not call for the provision of external hydrogen compression or generation facilities.

According to the invention, the feedstock is contacted with heated steam in the presence of the catalyst according to the invention at a pressure of less than or equal to about 300 psig, preferably less than 200 psig. The process temperature according to the invention is preferably between about 320° C. to about 550° C., preferably between 380° and 450° C. Either or both of the steam and feedstock may be preheated prior to entering the reactor if desired.

As set forth above, the catalyst containing the first and second metals may be provided according to the invention either in solid form, supported on a mesoporous support material, or may be provided as an additive for mixing with or dissolution in the feedstock. Further, according to the invention, one metal may suitably be supported on a support material while the other metal is added directly to the feedstock.

According to the invention, the catalyst in solid form preferably includes the first and second metals supported on the support material through any conventional manner in an amount by weight of the catalyst of at least about 0.5%, and preferably of at least 3.0%.

When the catalyst is to be dissolved in or mixed with the feedstock, sufficient amounts of the first and second metals are preferably used so as to provide a total concentration in the feedstock of at least about 500 ppm by weight of the feedstock, and preferably of at least 1000 ppm.

In either form, the catalyst according to the invention has a mole ratio of second metal (alkali) to first metal (non-noble Group VIII) greater than 0.25 and preferably greater than or equal to 1.0.

According to the invention, the process may suitably be carried out in any of numerous types of reactors including but not limited to fixed bed, batch, semi-batch, fluidized bed, circulating bed or slurry, and coil or soaker type visbreakers and the like. The process residence time varies depending upon the reactor type selected and the process temperature, and may be as short as a few seconds and as long as several hours or more.

According to the process of the present invention, a flow of steam is provided from any convenient source, and the catalyst metals are arranged in the reactor or mixed with the feedstock as desired. The feedstock is then contacted with the flow of steam in the reactor at process pressure and temperature. According to the invention, hydrogen from the steam is transferred to the heavy hydrocarbon feedstock during the process so as to provide a more valuable product having lower boiling point and a higher hydrogen content without the use of external sources of hydrogen gas and at a relatively low pressure. As will be demonstrated below, conventional thermal cracking processes do not significantly increase the amount of hydrogen in the hydrocarbon product.

According to the process of the invention, excellent rates of conversion of the residue fraction of the feedstock having a boiling point greater than 500° C. are accomplished. As will be further demonstrated in the examples below, conversion of the residue fraction in accordance with the invention exceeds at least about 50% by weight of the residue, and in some cases exceeds 80%. Further, coke production is not significantly increased and in most cases is reduced during the process.

Although the process of the present invention is a desirable alternative for processing any feedstock with significant amounts of residue fractions, it is preferable that the feedstock have a residue content of at least about 50% by weight prior to processing in accordance with the present invention.

It should be appreciated that the process according to the invention is efficient and economical and serves to provide a readily useable process for transforming or upgrading the residue fraction of a heavy hydrocarbon feedstock into valuable commercial products.

The conversion of the residue fraction of the feedstock having a boiling point greater than 500° C. as referred to herein is determined as follows:

$$\text{Conversion}(\%) = \frac{R_i - (R_f + C)}{R_i} \times 100$$

wherein:

$R_i$ is the amount of hydrocarbon in the feedstock having a boiling point greater than 500° C.;

$R_f$ is the amount of hydrocarbon in the product having a boiling point greater than 500° C.; and C is the amount of coke produced during the process.

The following examples further demonstrate the effectiveness of the catalyst and process of the present invention.

EXAMPLE 1

This example demonstrates the effectiveness of the catalyst of the present invention when the catalyst is directly dispersed into the feedstock, without any support. This example also illustrates the activity of the catalyst of the present invention compared to a prior art catalyst and to a thermal process without a catalyst. The results are shown in Table 1.

TABLE 1

| Catalyst | (Feed) | 1 None | 2 Ni/K | 3 Ni | 4 K | 5 Fe/Na | 6 Ni/Ba |
|---|---|---|---|---|---|---|---|
| Total metal concentration (ppm) | — | 0 | 1500 | 300 | 1200 | 1500 | 1500 |
| Group VIII metal conc. (ppm) | | 0 | 300 | 300 | 0 | 300 | 300 |
| Alkali (or Ba) conc. (ppm) | | 0 | 1200 | 0 | 1200 | 1200 | 1200 |
| Residue Conversion (%) | — | 44 | 76 | 49 | 46 | 69 | 57 |
| Weight of products (gr) | 150 | 153 | 150 | 148 | 149 | 149 | 150 |
| Gases | — | 11 | 14 | 15 | 8 | 14 | 10 |
| Liquids | 150 | 120 | 110 | 112 | 122 | 105 | 116 |
| Coke | — | 22 | 26 | 21 | 19 | 30 | 24 |
| Liquid product distribution (wt %) | | | | | | | |
| IBP-200° C. | 0 | 11 | 19 | 11 | 11 | 18 | 15 |
| 200° C.-350° C. | 0 | 18 | 26 | 19 | 18 | 2S | 23 |
| 350° C.-500° C. | 17 | 31 | 52 | 32 | 31 | 49 | 38 |
| >500° C. | 83 | 40 | 3 | 38 | 40 | 8 | 25 |

All the trials were carried out under the same operating conditions and in a 300 ml stainless steel reactor. In Table 1, trials 2 and 5 were run with a catalyst according to the invention. Trial 1 was run without a catalyst according to a standard thermal process. Trial 6 used a catalyst according to the prior art. Trial 3 was run with a non-noble metal (nickel) only and trial 4 was run with an alkali metal (potassium) only.

For trials 2–6, iron and nickel were added by dissolving the corresponding acetyl-acetonate salts of iron and nickel in the feedstock. In trial 6, the barium salt of oleic acid was dissolved into the feedstock. The alkali metals, sodium or potassium, for trials 2–5 were added to the feedstock through a water in xylene emulsion in a weight proportion of 5:95 in which the surfactant was the respective alkali salt of oleic acid. The concentration in the final mixture for each catalyst is shown in Table 1.

The feedstock was a 150 g sample of a heavy hydrocarbon containing 83% wt residue material with a boiling point greater than 500° C. A flow of 20 g/hr of water was pumped into a heater and the generated steam was bubbled into the reactor through the feedstock. The reactor temperature and pressure were maintained at 420° C. and 14 psig respectively for one hour. The feedstock was mixed with the catalyst and heated. While the flow of steam continued, light hydrocarbon and gases were produced. The light hydrocarbon products and the excess steam were condensed, separated and collected at the exit of the reactor, while the flow of gases (non-condensable products) was measured after the condenser and its composition determined by gas chromatography.

The process was run for one hour, with the reactor temperature maintained at 420° C. and the flow of water at 20 g/hr. At the end of the treatment, a heavy liquid fraction that remained in the reactor was separated from the solids (coke plus spent catalyst) and combined with the light fraction produced during reaction.

The composition of the total liquid product was determined by simulated distillation according to ASTM standard test method D5307 and the fraction of material in four boiling point ranges was determined as set forth above (IBP to 200° C.; 200° C. to 350° C.; 350° C. to 500° C.; and greater than 500° C.).

The catalyst of the present invention (Trials 2 and 5) led to a higher conversion of the high boiling point fraction when compared with the thermal process (trial 1) and with the catalyst of the prior art (trial 6).

Further, the catalyst of the present invention having a mixture of alkali metal and non-noble Group VIII metal shows conversion rates significantly greater than each of the metals by themselves (trials 3 and 4), indicating that there is a synergistic effect between the alkali metal and the non-noble Group VII metal in accordance with the present invention.

EXAMPLE 2

This example illustrates the effectiveness of the catalyst of the present invention when the active phase is dispersed on a solid support. It also demonstrates that the catalyst is more effective when the process pressure is less than 300 psig.

The catalyst was prepared as follows. The support was an aluminosilicate with substantial mesoporous pore volume (0.3 ml/g), prepared as an extrusion. Water salts of potassium and nickel were impregnated on the support, so as to provide a total metal loading of 3% by weight, at a mole ratio of potassium to nickel of 4.0. The catalyst was then calcined and loaded into a fixed bed reactor. The total catalyst volume in the reactor was 15 ml.

The catalyst was exposed to a continuous flow of hydrocarbon feedstock.

The system was operated as a fixed bed reactor with ascending flow of feedstock and steam, under isothermal conditions at 420° C., and a space velocity of 1.0 vol feed/vol catalyst/hr. The hydrocarbon feedstock was a natural bitumen containing 60% by weight of high boiling point material (boiling point greater than 500° C.). The ratio of the bitumen to steam going through the catalyst was 2.3. The system was operated under steady conditions for 6 hours. All liquid and gas products plus non reacting steam were collected and separated at the exit of the reactor. Coke produced during the reaction and deposited on the catalyst surface was measured by weight.

Residue conversions obtained after six hours at 150, 300 and 450 psig are set forth below in Table 2.

TABLE 2

| | 1 | 2 | 3 |
|---|---|---|---|
| Total metal loading on support (wt %) | 3 | 3 | 3 |
| Nickel loading (wt %) | 0.82 | 0.82 | 0.82 |
| Potassium loading (wt %) | 2.18 | 2.18 | 2.18 |
| Reactor temperature (°C.) | 420 | 420 | 420 |
| Reactor pressure (psi) | 150 | 300 | 450 |
| Reaction time (hr) | 6.5 | 6.0 | 6.5 |
| Residue flow rate (mL/hr) | 6.34 | 6.34 | 6.34 |
| Water flow rate (mL/hr) | 4.50 | 4.50 | 4.50 |
| Residue conversion (%) | 73 | 73 | 58 |

As shown in Table 2, the catalyst of the present invention is most effective when the pressure is less than or equal to 300 psig.

EXAMPLE 3

This example illustrates the effectiveness of the catalyst of the present invention at different molar ratios of the active phases.

All the trials were carried out under the same operating conditions in a 300 mL stainless steel reactor. Trial 1 was run without a catalyst according to a standard thermal process. Trials 2 and 3 were run with catalysts according to the invention, containing different molar ratios of the active phases.

For trials 2 and 3, nickel was added by dissolving the acetyl-acetonate salt in the feedstock, and potassium was added through a water in oil emulsion in a weight proportion 5:95 in which the surfactant was the potassium salt of naphthenic acids from crude oil. The concentration in the final mixture for each catalyst is shown in Table 3.

The feedstock was a heavy hydrocarbon containing 83% wt residue material with a boiling point greater than 500° C. Flows of 30 gr/hr of feedstock containing the catalyst and 20 gr/hr of water were pumped into the reactor. The reactor temperature and pressure were maintained at 420° C. and 14 psig respectively. Light hydrocarbons, gases and excess steam were continuously flowing out of the reactor during the duration of the experiments. The light hydrocarbon products and the excess steam were condensed, separated and collected at the exit of the reactor, while the flow of gases (non-condensable products) was measured after the condenser and its composition determined by gas chromatography. The process was run for one hour. At the end of the treatment, a heavy liquid fraction that remained in the reactor was separated from the solids (coke plus spent catalyst) and combined with the light fraction produced during reaction.

The composition of the total liquid product was determined by simulated distillation according to ASTM standard method D5307 and the fraction of material with boiling point less than 500° C. was determined.

Table 3 shows that the catalyst of the present invention (trials 2 and 3) led to higher conversion of the high boiling point fraction when compared with the thermal process (trial 1).

TABLE 3

| | 1 | 2 | 3 |
|---|---|---|---|
| Nickel conc. (ppm) | 0 | 388 | 388 |
| Potassium conc. (ppm) | 0 | 267 | 67 |
| Molar Ratio K/Ni | — | 1.0 | 0.25 |
| Reactor temperature (°C.) | 420 | 420 | 420 |
| Reactor pressure (psi) | 15 | 15 | 15 |
| Feedstock flow rate (mL/hr) | 30 | 30 | 30 |
| Water flow rate (mL/hr) | 20 | 20 | 20 |
| Residue conversion (%) | 45 | 71 | 57 |

EXAMPLE 4

This example further demonstrates the effectiveness of the catalyst of the present invention when operated under steady state conditions in a continuous flow reactor with a continuous supply of catalyst.

Three trials are described in this example. They were carried out under the same operating conditions, with the sole difference that in trial 1 no catalyst was present, in trial 2 the catalyst was dispersed on a mesoporous natural aluminosilicate, and mixed with the feed, and in trial 3 the catalyst was directly dissolved into the feed as nickel acetyl-acetonate and as a water in oil emulsion where the surfactant is the potassium salt of naphthenic acids.

Trials for this example were carried out in a slurry type continuous-flow system. In all cases, 315 g/hr of heavy feedstock were pumped from a tank and heated to 200° C. in a preheater. 83% by weight of the feedstock had a boiling point greater than 500° C. After the preheater, the feedstock was mixed with a flow of 250 g/hr of steam, also at 200° C. The feedstock/steam mixture was further heated to 350° C., and introduced into a reactor where it reached reaction temperature. The residence time in the reactor was 2 hours. The reactor pressure was maintained at 150 psig. At the reactor exit, the products plus excess steam were introduced into a chamber maintained at 250° C., where the heavy liquid and solid products were separated from the light products, gases and excess steam, which were introduced into a cooling chamber operated at 100° C., where the light products and excess steam were condensed and separated from the gases. The flow of gases after separation was measured and the composition of the gas determined by gas chromatography. The heavy liquid fraction was separated from the solids (coke and spent catalyst), and combined with the light products. The composition of the total liquid product was determined by distillation, following ASTM standard test method D308, and the fraction of material in the four above mentioned boiling point ranges was determined.

In trial 2 a supported catalyst containing nickel and potassium was mixed with the feed. It was prepared following a procedure similar to the one described in Example 2, but provided in powder form instead of an extrusion.

In trial 3 the catalyst was dissolved into the feed in the form of an oil soluble nickel salt (acetyl-acetonate) and a water in oil emulsion containing potassium naphthenate as a surfactant. This catalyst was prepared following the same procedure as in trial 2 of Example 1. In trials 2 and 3 of this example the potassium and nickel concentrations in the feedstock after dispersing the catalyst were 1200 and 400 ppm respectively.

The conditions and results for these trials are shown in Table 4.

TABLE 4

| | 1 | 2 | 3 |
|---|---|---|---|
| Type of catalyst | None | Solid | Soluble |
| Total catalyst loading in the feed (ppm) | 0 | 1600 | 1600 |
| Nickel loading in the feed (ppm) | 0 | 400 | 400 |
| Potassium loading in the feed (ppm) | 0 | 1200 | 1200 |
| Reactor temperature (°C.) | 408 | 420 | 425 |
| Reactor pressure (psi) | 150 | 150 | 150 |
| Space velocity (1/hr) | 0.9 | 0.6 | 0.6 |
| Water/feed (wt/wt) | 0.5 | 0.6 | 0.6 |
| Residue conversion (%) | 43 | 56 | 68 |
| Asphaltene conversion (%) | −70 | 19 | 19 |
| Coke yield (%) | 2 | 5 | 1 |

Trial 1 could only be carried out at a temperature of 408° C. and a 1 hour residence time in the reactor. Higher temperatures and longer residence times resulted in formation of excessive amounts of coke that plugged the reactor and prevented continuous steady state operation.

Under the conditions employed in trial 1, a heavy hydrocarbon conversion of only 43% wt was achieved. Furthermore, undesirable asphaltenic compounds were generated rather than converted. In trial 2, the reaction temperature was raised to 420° C., and the residence time was increased to 2 hours. Under these conditions, 56% wt of the heavy hydrocarbon was converted. The results were even better when the soluble catalyst formulation was employed (trial 3). In this case, at a reaction temperature of 425° C. and a residence time of 2 hours, 68% wt of the residue fraction of the heavy hydrocarbon feedstock was converted, with a coke yield of only 2% wt.

The results summarized in Table 4 demonstrate that the catalyst and process of the present invention allow higher conversions of heavy hydrocarbon and lower coke yield under steady state conditions than a conventional thermal process. This represents a more efficient and economically attractive process for the conversion of heavy hydrocarbon feedstock into valuable products.

EXAMPLE 5

This example illustrates the transfer of hydrogen from the steam to the process product which is at least partially responsible for the desirable conversion achieved according to the process of the present invention.

The trials described in this example were identical to trials 1 and 2 in Example 1. In this case, however, the hydrogen and carbon content of all the collected products was determined, as was a total hydrogen to carbon ratio. Table 5 set forth below shows the results of this example.

TABLE 5

| | | 1 | 2 |
|---|---|---|---|
| Catalyst | (Feed) | None | Ni/K |
| Total metal concentration (ppm) | — | 0 | 1500 |
| Nickel conc. (ppm) | | 0 | 300 |
| Potassium conc. (ppm) | | 0 | 1200 |
| Residue conversion (%) | — | 44 | 76 |
| Weight of products (gr) | 150 | 153 | 150 |
| Gases | — | 11 | 14 |
| Liquids | 150 | 120 | 110 |
| Coke | — | 22 | 26 |
| Liquid product distribution (wt %) | | | |

TABLE 5-continued

| | | 1 | 2 |
|---|---|---|---|
| IBP–200° C. | 0 | 11 | 19 |
| 200° C.–350° C. | 0 | 18 | 26 |
| 350° C.–500° C. | 17 | 31 | 52 |
| >500° C. | 83 | 40 | 3 |
| Hydrogen to carbon molar ratio | | | |
| Total | 1.45 | 1.46 | 1.55 |
| Gases | | 3.10 | 3.20 |
| Liquids | 1.45 | 1.50 | 1.61 |
| Solids | | 0.42 | 0.41 |

In the absence of the catalyst according to the present invention, the combined H/C mole ratio of the products was essentially the same as that of the feedstock (1.46 vs. 1.45). When the nickel/potassium catalyst according to the invention was used, there was an increase in the H/C ratio from 1.45 to 1.55. This indicates that with the use of the catalyst and process according to the present invention, hydrogen from the steam is transferred or incorporated into the conversion products, thus resulting in a greater fraction of lighter, more valuable products. This is an important economic feature of the invention, since accomplishing the same task using hydrogen gas involves a high capital investment associated with the production of hydrogen gas and the high pressures associated therewith.

This invention may be embodied in other forms or carried out in other ways without departing from the spirit or essential characteristics thereof. The present embodiments are therefore to be considered as in all respects to be illustrative and not restrictive, the scope of the invention being indicated by the appended claims, and all changes which come within the meaning and range of equivalency are intended to be embraced therein.

What is claimed is:

1. A catalyst comprising a first metal selected from the group consisting of non-noble Group VIII metals and mixtures thereof and a second metal comprising an alkali metal wherein at least one of said first and second metals is in the form of an oil soluble compound.

2. A catalyst according to claim 1, wherein said first metal is selected from the group consisting of iron, cobalt, nickel and mixtures thereof.

3. A catalyst according to claim 1, wherein said second metal is selected from the group consisting of potassium, sodium and mixtures thereof.

4. A catalyst according to claim 1, wherein at least one of said first and second metals is supported on a mesoporous support material.

5. A catalyst according to claim 4, wherein said support material is selected from the group consisting of silica, aluminosilicates, aluminas, cokes, carbon based materials, and mixtures thereof.

6. A catalyst according to claim 4, wherein said support material has a pore volume of at least about 0.3 ml/g.

7. A catalyst according to claim 4, wherein said first and second metals are both supported on said support material and are present in an amount of at least about 0.5% with respect to the total catalyst weight.

8. A catalyst according to claim 4, wherein said first and second metals are both supported on said support material and are present in an amount of at least 3.0% with respect to the total weight of the catalyst.

9. A catalyst according to claim 1, wherein said first and second metals are present in a mole ratio of second metal to first metal of greater than 0.25.

10. A catalyst according to claim 1, wherein at least one of said first and second metals is in the form of an oil soluble salt.

11. A catalyst according to claim 10, wherein said oil soluble salt is selected from the group consisting of acetylacetonate salts, salts of fatty or naphthenic acids, organometallic compounds and mixtures thereof.

12. A catalyst according to claim 1, wherein at least one of said first and second metals is in the form of a water soluble salt selected from the group consisting of nitrates, chlorides, sulfates, acetates and mixtures thereof.

13. A catalyst according to claim 1, wherein at least one of said first and second metals is in the form of a surfactant of a water in oil emulsion.

14. A catalyst according to claim 1, wherein said first and second metals are present in a mole ratio of second metal to first metal of greater than 1.0.

15. A catalyst according to claim 1, wherein at least one of said first and second metals is in the form of an oil soluble salt.

16. A catalyst for steam conversion of heavy hydrocarbon, comprising a first metal selected from the group consisting of non-noble Group VIII metals and mixtures thereof and a second metal comprising an alkali metal wherein at least one of said first and second metals is in the form of an oil soluble salt and wherein said catalyst is active to convert said heavy hydrocarbon at a pressure of less than or equal to about 300 psig.

17. A catalyst for steam conversion of heavy hydrocarbon, consisting of a first metal selected from the group consisting of non-noble Group VIII metals and mixtures thereof and a second metal comprising an alkali metal wherein at least one of said first and second metals is in the form of an oil soluble salt and wherein said catalyst is active to convert said heavy hydrocarbon at a pressure of less than or equal to about 300 psig and wherein at least one of said first and second metals is supported on a mesoporous support material.

* * * * *